US006158343A

United States Patent [19]

Hoffman, Jr. et al.

[11] Patent Number: 6,158,343

[45] Date of Patent: Dec. 12, 2000

[54] CONTAMINANT REMOVER FOR PRINTING MACHINE

[75] Inventors: Richard C. Hoffman, Jr., Lake Forest; Alex Iaccino, Mount Prospect; Dariusz Tkacz, Naperville; Roman Guzek, Addison, all of Ill.

[73] Assignee: M&R Printing Equipment, Inc., Glen Ellyn, Ill.

[21] Appl. No.: 09/322,562

[22] Filed: May 28, 1999

[51] Int. Cl.[7] ..... B41L 41/00

[52] U.S. Cl. ..... 101/425; 101/126

[58] Field of Search ..... 101/423, 424, 101/425, 129, 126

[56] References Cited

U.S. PATENT DOCUMENTS

| | | | |
|---|---|---|---|
| 2,858,576 | 11/1958 | Rose | 19/140 |
| 3,505,699 | 4/1970 | Trumbull | 15/104 |
| 3,952,654 | 4/1976 | Evans | 101/425 |
| 4,905,337 | 3/1990 | McKay . | |
| 4,905,596 | 3/1990 | Kobler . | |
| 4,990,192 | 2/1991 | Pallone et al. . | |
| 5,027,465 | 7/1991 | McKay . | |
| 5,070,782 | 12/1991 | Sakai et al. | 101/123 |
| 5,150,273 | 9/1992 | LaVantine . | |
| 5,213,040 | 5/1993 | Mihori et al. | 101/424 |
| 5,385,096 | 1/1995 | Suzuki . | |
| 5,483,879 | 1/1996 | Tani et al. | 101/123 |
| 5,553,344 | 9/1996 | Rosenkrantz . | |

FOREIGN PATENT DOCUMENTS

| | | | |
|---|---|---|---|
| 61-209158 | 9/1986 | Japan | 101/425 |
| 2-80250 | 3/1990 | Japan | 101/425 |

*Primary Examiner*—Ren Yan
*Attorney, Agent, or Firm*—Wallenstein & Wagner, Ltd.

[57] ABSTRACT

A contaminant remover for a screen printing operation using a multiple station printing machine having at least a first printing station is disclosed. The contaminant remover has a support arm attached to the first printing station of the printing machine, and a contaminant removal surface attached to the support arm. As a printing surface is automatically brought into printing alignment with the first printing station, the contaminant removal surface engages the printing surface and moves across the printing surface to remove contaminants which may undesirably block portions of the screen. The contaminant removal surface is preferably a plurality of removable roller brushes having an adhesive applied to their respective surfaces.

17 Claims, 3 Drawing Sheets

CONTAMINANT REMOVER FOR PRINTING MACHINE

TECHNICAL FIELD OF THE INVENTION

The present invention relates to the field of screen printing. Particularly, the present invention relates to an apparatus for the pre-removal of contaminants from a printing surface and, more particularly, to a detachable contaminant remover for attaching to a screen printing machine.

BACKGROUND OF THE INVENTION

Printed indicia for applying to items of clothing, such as T-shirts, sweatshirts, golf shirts, shorts, hats, and the like, as well as other cloth and paper goods, such as banners, posters, bags, flags, and the like, have become very popular over the last 20 years. Boutiques specializing in printing fanciful and textual indicia such as slogans, college names, sports team names and logos, licensed characters, and the like, on these various media, are commonly seen in stores across the country. The indicia available at these stores can be pre-printed on a substrate and applied with a heated press by operators at such boutiques to any of the aforementioned items purchased by a consumer, or they can be screen printed directly onto the items for later purchase.

In the screen printing process, a stencil screen is typically blocked (called "masked" in the industry) to embody the desired indicia and is then placed over the item to be printed. Ink of one color is then flooded onto the screen by a flood bar of conventional design. The ink may be of any type well-known in the industry for screen printing. After the ink is flooded onto the screen, the ink is squeegeed through the screen interstices onto the item, leaving ink of the desired color where the interstices in the screen are unblocked. The squeegee can be of any type known in the art.

Problems arise, however, when the printing is done upon a material, such as cotton, wool, paper, polyester, and the like, where contaminants are likely to adhere to the printing surface. The term "contaminant" is intended to be all encompassing and to include non-permanent material on the printing surface including, but not limited to lint, dust, dirt, synthetic or natural material fizz, human hair, cloth fibers, metal flakes, paint chips, and a variety of other undesirable debris capable of making its way onto a printing surface. These contaminants may be picked up on the printing screen and block previously unblocked interstices, causing imperfections on subsequent printing surfaces.

To correct this problem, two things must be done. First, the contaminant must be located and removed from the printing screen to prevent further printing imperfections. This is typically performed manually by the printing machine operator using a clean cloth or the tacky side of a length of tape. If the printing machine must be stopped, valuable printing time may be lost. Alternatively, if the operator attempts to locate and remove the debris during continuous operation, there is risk of injury to the operator and damage to the equipment.

Second, each of the printing surfaces containing an imperfection must be fixed or corrected. Depending upon the area, size, and shape of the imperfection, the operator or other personnel manually applies ink of the desired color to the spot with a suitable applicator. This approach requires the time of personnel who may be neglecting other duties in the printing process. Additionally, the intricacy of the printed indicia may be difficult to impossible to "touch up," leaving the item to be printed upon imperfect or ruined.

A few reasons for automatically removing contaminants from a printing surface are: (1) to allow printing machine operators to concentrate on other areas of printing; (2) to diminish the likelihood of ruining printed articles and printing screens; (3) to lessen printing machine downtime; and, (4) to reduce injury risk to printing machine operators.

In the printing field, several attempts have been made to develop methods and apparatus for cleaning printing devices. For instance, U.S. Pat. No. 4,905,596 to Kobler, is directed to a combined cleaning and safety device for a rotary printing cylinder. The device provides a cleaning arrangement including brushes for brushing against the surface of a printing cylinder to remove lint, dust, dirt and other contaminants. However, this type of printing is very different from the screen printing addressed by the present invention. U.S. Pat. No. 5,385,096 to Suzuki discloses a printing plate contaminant removing device for a printing press. The Suzuki invention uses a timing belt having a plurality of contaminant removal blades for scraping debris from a printing cylinder. This device is also very different from the present invention.

Likewise, U.S. Pat. No. 5,150,273 to Le Vantine discloses a device for removing dust, lint, and static charge from film and plastic surfaces. The Le Vantine invention also makes use of bristled brushes to sweep away the contaminants from the material surface. Le Vantine does not address the problems solved by the present invention, nor does the patent disclose the use of the invention with a screen printing machine.

Other contaminant removal devices, unrelated to the field of printing, include U.S. Pat. No. 5,553,344 to Rosenkrantz, disclosing a handled pick-up device; and U.S. Pat. Nos. 4,905,337 and 5,027,465, both to McKay, disclose rolling lint removers. None of these devices have been intended to address the long felt need for an automatic contaminant remover in the area of screen printing.

SUMMARY OF THE INVENTION

In accordance with the present invention, new methods and apparatus for attaching to a screen printing machine and removing contaminant from a printing surface, such as shirts, shorts, hats, flags, banners, bags, and the like, are provided. One embodiment of the present invention includes a support arm connected to a first printing station of the printing machine, and a contaminant removal surface, at least equal to a dimension of the printing surface, attached to the support arm. The invention further includes an automatic mechanism for bringing the first printing surface into printing alignment with the first printing station, an automatic mechanism for bringing the removal surface into contact with the first printing surface, and an automatic mechanism for moving the removal surface across the first printing surface.

It is an aspect of the present invention to arrange for a single automatic mechanism to provide the function of the automatic mechanism for bringing printing alignment, the automatic mechanism for bringing contact, and the automatic mechanism for moving.

It is another aspect of the present invention to provide a detachable contaminant removal surface having at least one roller brush. Preferably, the removal surface comprises a plurality of roller brushes. The roller brushes are preferably removable from the support arm to allow replacement of worn or dirty roller brushes.

It is still another aspect of the present invention to provide an adhesive layer applied to the removal surface. The adhesive layer may be either manually sprayed onto the contaminant removal surface or automatically applied to the contaminant removal surface. A biasing arm may be provided to maintain physical communication of the contaminant removal surface with the printing surface as the printing surface is moved across.

In the disclosed methods, contaminants are removed from a printing surface in a screen printing operation by engaging a contaminant removal surface with the printing surface, then automatically moving the contaminant removal surface across the printing surface, preferably by rolling. Simultaneously, the first support surface with the printing surface is brought into printing alignment with a first printing station.

DETAILED DESCRIPTION OF PREFERRED EMBODIMENT

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1–4, the process of a screen printing operation using the present invention can be more readily understood. The disclosed contaminant remover is generally referenced by the number "10" in the following disclosure and drawings. Other components are similarly and consistently numbered throughout. While the present invention is particularly designed for automatic printing machines, such as, for example, the CHALLENGER™ and the GAUNTLET™, and their progeny, manufactured by M&R Printing Equipment, Inc. of Glen Ellyn, Ill., manual systems may be capable of adaption as well.

Figure 1:
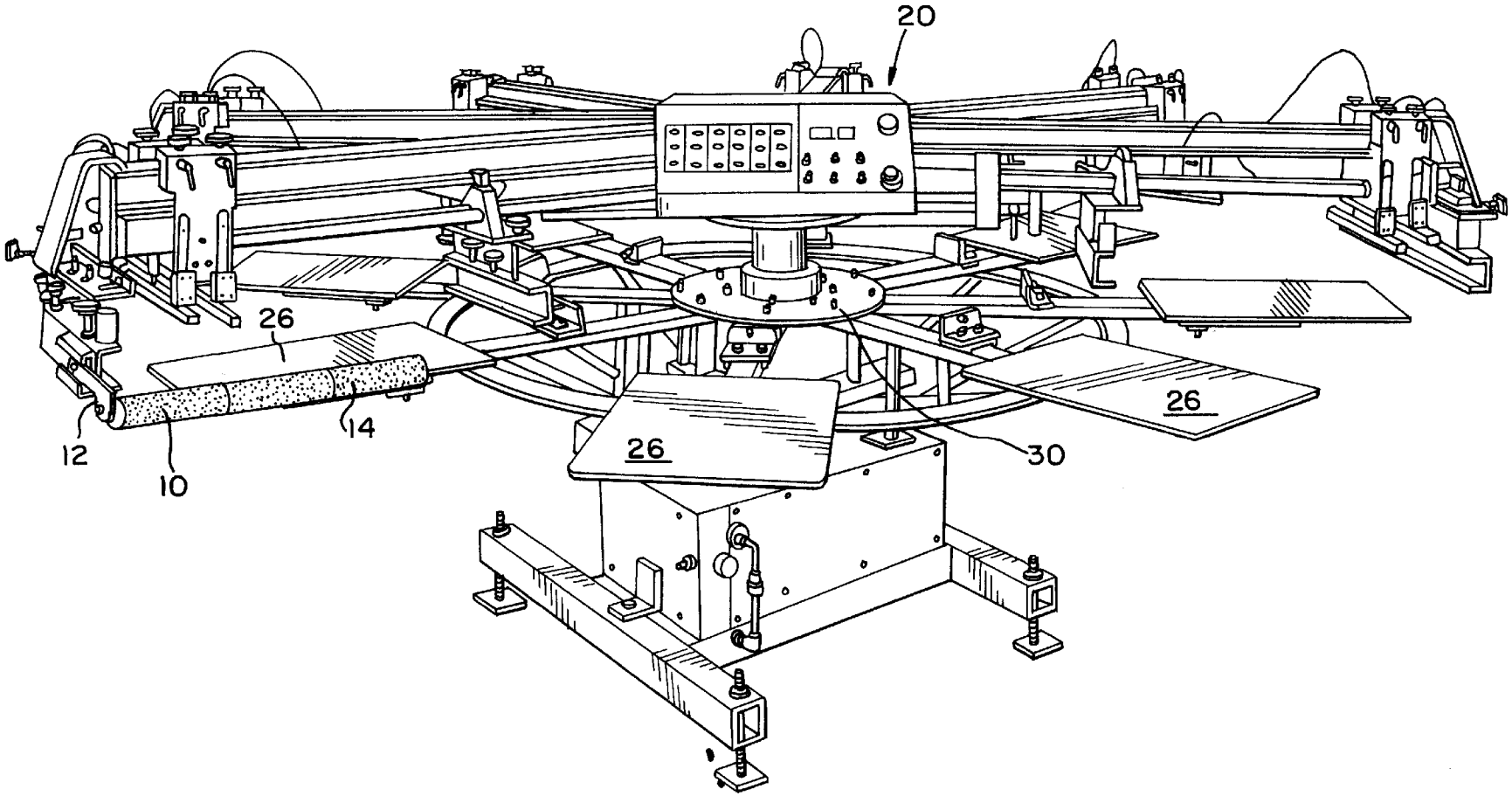
FIG. 1 is a perspective view of a rotary printing machine and illustrates the placement of one embodiment of the present invention.

As shown in FIG. 1, the present contaminant remover 10 has a support arm 12 connected to a first printing station 22 of a printing machine 20. Attached to the support arm 12 is a removal surface 14. The removal surface 14 is at least equal to a dimension of a first printing surface. The "printing surface" is defined as the area of the article available for printing. That is, for example, for a T-shirt having a front panel of about 14 in.×20 in. (35.6 cm×50.8 cm) for printing of an indicia of about 6 in.×8 in. (15.2 cm×20.3 cm), the removal surface 14 should preferably be no less than either about 14.0 inches (35.6 cm) or about 20.0 inches (50.8 cm) in length, depending on the positioning of the T-shirt within the printing station. This permits the removal surface 14 to contact the entire printing surface in a single pass to remove contaminants. Alternatively, however, the removal surface 14 could be suitable for the purposes of the present invention at a length no less than a dimension of the indicia to be printed. In the present example, either 6.0 inches (15.2 cm) or 8.0 inches (20.3 cm), depending on the positioning of the indicia on the shirt. While the entire printing surface is not contacted by the removal surface 14 with this alternate design, it is nonetheless possible to remove contaminants from the area to be covered by the indicia.

Figure 2:
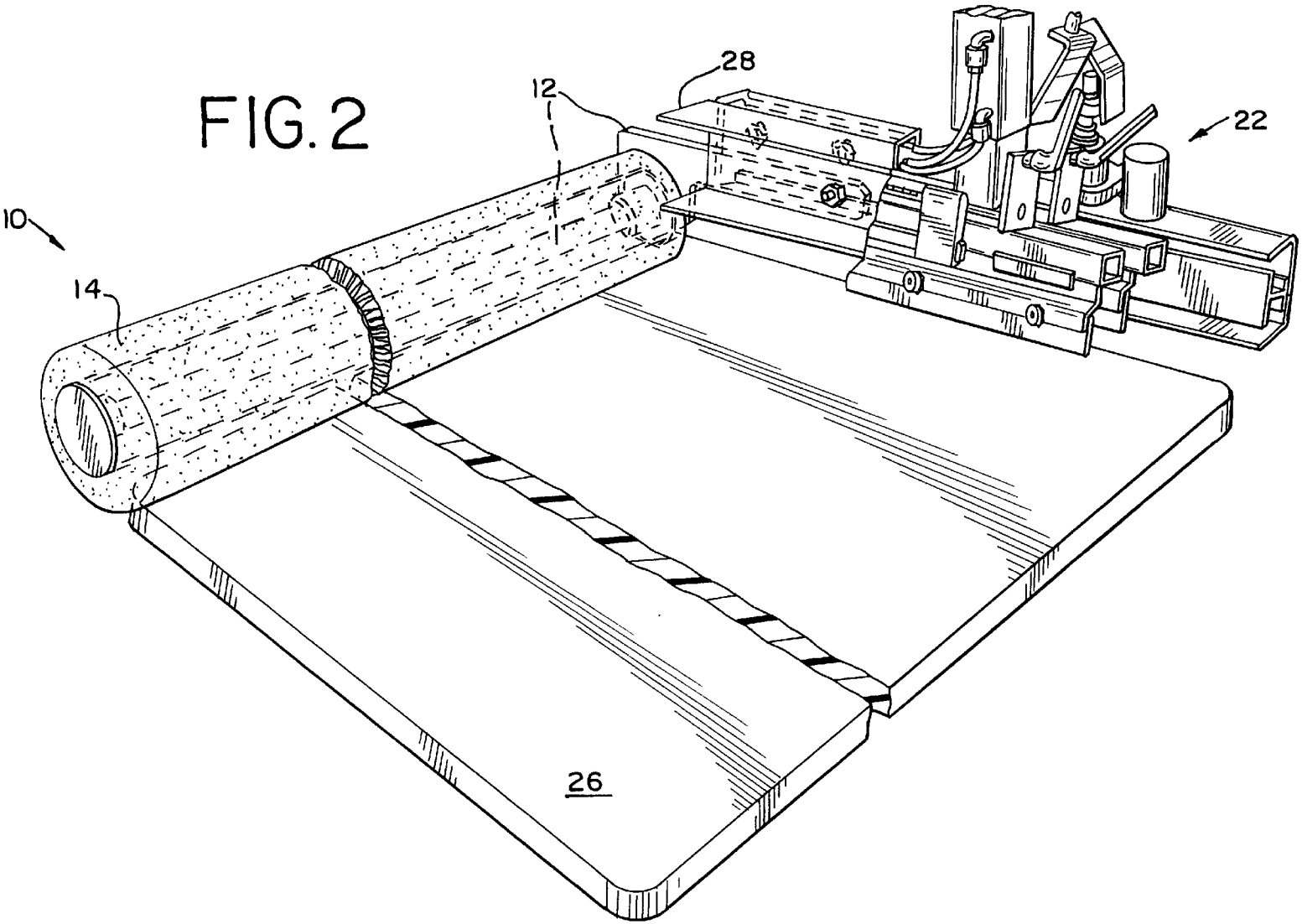
FIG. 2 is a close up view of one embodiment of the present invention.

Generally, an automatic mechanism is provided for bringing the first printing surface into printing alignment with the first printing station 22 in a multi-stationed printing machine 20. Those skilled in the relevant art will readily understand how each article to be printed on can be supported on a platen 26 attached to a rotating carousel 30 of the printing machine 20, as shown in FIG. 2. The platen 26, of which there are typically at least as many as printing stations, moves from printing station to printing station via the carousel 30 of the printing machine 20. While one of the printing stations is designated a first printing station 22 by the attachment of contaminant remover 10, a platen 26 preceding the designated printing station is designated as the support for the first printing surface to be brought into printing alignment. Upon activation of an automatic control system of the printing machine 20, the first printing surface is brought into printing alignment with the first printing station 22, via a first platen 26.

Referring to FIG. 2, an automatic mechanism for bringing the removal surface 14 into contact with the first printing surface is shown. The support arm 12 attaches the contaminant removal surface 14 to the first printing station 22 in parallel with a leading edge 28 of the printing station. The removal surface 14 is preferably extended outward and downward from the leading edge 28, allowing contact between the removal surface 14 and the printing surface as the platen 26 carrying the printing surface is rotated to align with the printing station. The parallel mounting of the contaminant remover 10 does not interfere with screen printing at the first printing station 22.

Figure 3:
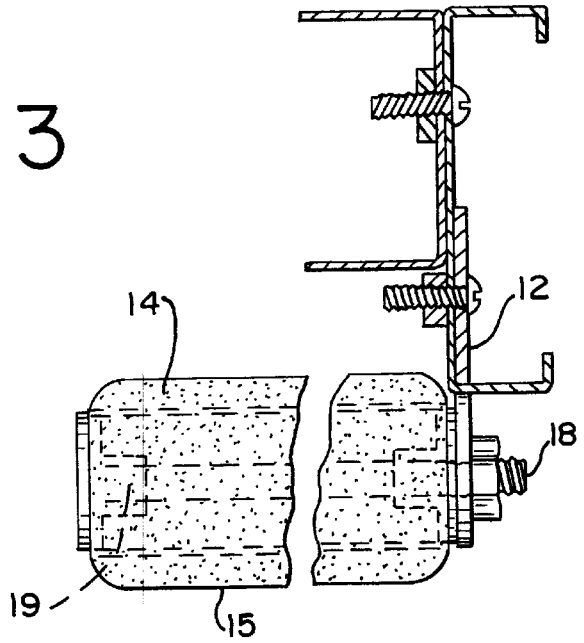
FIG. 3 is a front plan view of the embodiment of FIG. 2.

The contaminant removal surface 14, as shown in FIG. 3, is preferably at least one roller brush 15, such as used for paint rollers. In the present embodiment, three eight-inch roller brushes are aligned on the support arm 12 in series. The rollers are preferably sprayed with a suitable conventional adhesive to make them "stickier" for picking up contaminants coming into contact therewith. Application of this adhesive layer may be accomplished by manual spraying, or using an automatic adhesive applicator, such as the ANNAMISTER™ manufactured and sold by M&R Printing Equipment, Inc. of Glen Ellyn, Ill.

Figure 4:
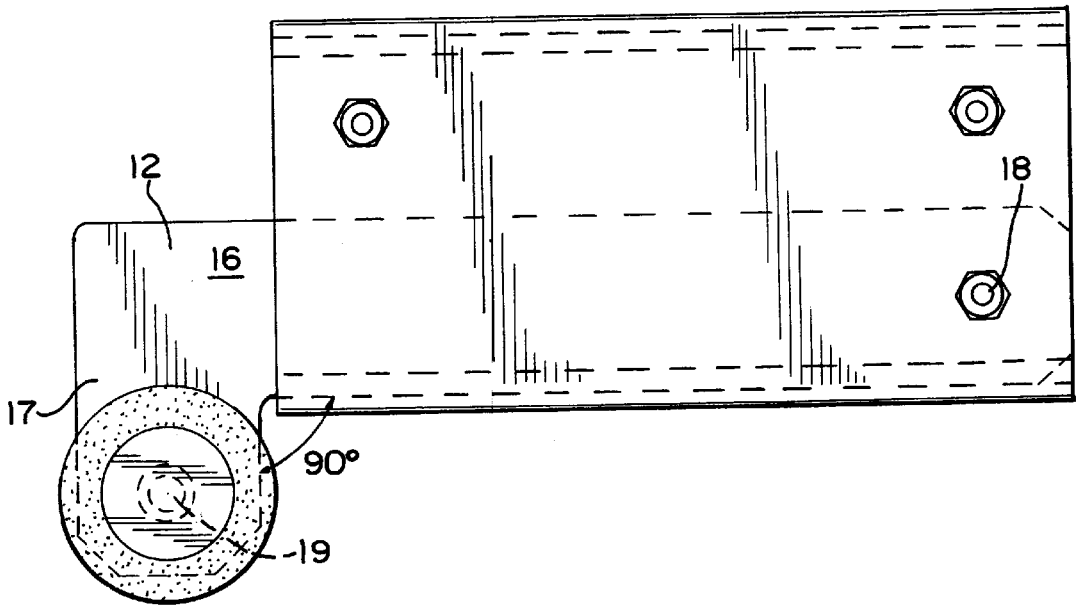
FIG. 4 is a side plan view of an embodiment of the present invention.

The support arm 12 is preferably comprised of a length of flat stock stainless steel 16—although other rigid metals such as aluminum, aluminum alloys, and the like may be used as well—having a planar section 17 at about 90° off one end, a mounting bolt hole 18 at the other end, and a rod section 19 perpendicularly attached by one end to the planar section 17, as shown in FIG. 4. The other end of the rod section 19 of the support arm 12 is preferably free standing (i.e., without further attachment to other components). The rollers 15 of the contaminant removal surface 14 are preferably held onto the rod section 19 of the support arm 12 in a manner similar to a design structure used to hold paint rollers onto a paint roller handle. Any suitable design structure capable of properly engaging the rollers will suffice. In the present embodiment, the roller brushes 15 are free to roll as they contact and move across a surface, and can be readily removed from the free standing end of the rod section 19. The roller brush removable feature allows any of the rollers to be replaced with a new roller brush 15, if necessary, or even cleaned and returned to the support arm 12, if desired. Certainly, an infinite number of other alternative configurations of the support arm 12 and roller assembly, too numerous to list herein, are possible. Such alternatives should be considered to fall within the scope of the present claims to the extent they achieve substantially the same result, in substantially the same way.

As the printing machine 20 brings the platen 26 supporting the first printing surface into alignment with the first printing station 22, it also serves as an automatic mechanism for moving the contaminant removal surface 14 across the first printing surface. That is, the removal surface 14 is first brought into contact with the printing surface, and then is moved across the surface to pick up contaminants as the printing surface is brought into printing alignment with the first printing station 22. Additionally, a biasing arm (not shown) may be utilized with an embodiment of the present invention to assist in maintaining physical communication between the two surfaces. While the added benefit of attaching additional contaminant removers 10 to a leading edge 28 of subsequent printing stations is minimal, such a configuration may be desirable in an extreme work environment (i.e., where potential for continued contamination of the printing surface is higher).

In the preferred embodiment, the automatic mechanism for bringing printing alignment, the automatic mechanism for bringing contact, and the automatic mechanism for moving are all provided by the same mechanism. Preferably, the mechanism is the printing machine 20 having a computer automated servo-drive, as previously discussed. The printing surface is automatically moved by this mechanism on the carousel 30 of the printing machine 20. The movement allows the contaminant remover 10 of the present invention to contact and move across the printing surface.

After printing alignment is achieved between the first printing surface and the first printing station 22, the article may be screened in any manner known by those skilled in the art. The unique mounting configuration of the present invention allows printing at the same station where decontamination is occurring (i.e., the first printing station 22). The method of removing contaminants can be continued for successive articles as they are brought into printing alignment, via successive platens, with the first printing station 22.

While specific embodiments have been illustrated and described, numerous modifications are possible without departing from the spirit of the invention, and the scope of protection is only limited by the scope of the accompanying claims.

We claim:

1. A contaminant remover in combination with a printing machine, comprising:

a support arm connected to a printing station of the printing machine;

a printing area being selectively moved relative to the printing station;

a removal surface attached to the support arm and having a length at least equal to a dimension of the printing area;

an automatic mechanism for bringing the printing area into contact with the removal surface; and an automatic mechanism for moving the printing area while maintaining contact with the removal surface.

2. The contaminant remover of claim 1, wherein the automatic mechanism for bringing the printing area into contact and the automatic mechanism for moving the printing area are the same mechanism.

3. The contaminant remover of claim 2, wherein the mechanism comprises an automatic screen printing machine having a rotating carousel.

4. The contaminant remover of claim 1, wherein the removal surface is parallel to a leading edge of the printing station.

5. The contaminant remover of claim 1, wherein the removal surface is rotatably attached about the support arm.

6. The contaminant remover of claim 1, wherein the removal surface comprises at least one roller brush.

7. The contaminant remover of claim 6, wherein the removal surface comprises a plurality of roller brushes.

8. The contaminant remover of claim 7, wherein the roller brushes are removable from the support arm.

9. The contaminant remover of claim 1, wherein the removal surface is detachable from the support arm.

10. The contaminant remover of claim 1, further comprising an adhesive layer applied to the removal surface.

11. The contaminant remover of claim 10, further comprising means for manually applying the adhesive layer onto the removal surface.

12. The contaminant remover of claim 10, further comprising means for automatically applying the adhesive layer onto the removal surface.

13. The contaminant remover of claim 1, further comprising a biasing arm for maintaining physical communication of the removal surface with the printing area as it is moved.

14. The contaminant remover of claim 13, wherein the removal surface comprises at least one roller brush.

15. The contaminant remover of claim 14, wherein the removal surface comprises a plurality of roller brushes.

16. The contaminant remover of claim 15, wherein the roller brushes are removable from the support arm.

17. The contaminant remover of claim 1, wherein the support arm is adjustable about the connection to the printing station of the printing machine.

* * * * *